US010292227B1

(12) United States Patent
Moumen et al.

(10) Patent No.: US 10,292,227 B1
(45) Date of Patent: May 14, 2019

(54) LIGHT INTENSITY CONTROL OF AN LED LIGHTING SYSTEM

(71) Applicant: Valeo North America, Inc., Troy, MI (US)

(72) Inventors: Monji Moumen, Columbus, IN (US); Fabrizio Palmieri, Troy, MI (US); David Le-Guen, Troy, MI (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 15/998,511

(22) Filed: Aug. 16, 2018

(51) Int. Cl.
*H05B 33/08* (2006.01)
*H05B 37/02* (2006.01)

(52) U.S. Cl.
CPC ..... *H05B 33/0848* (2013.01); *H05B 33/0809* (2013.01); *H05B 37/029* (2013.01)

(58) Field of Classification Search
CPC ..... H05B 37/00; H05B 37/02; H05B 37/029; H05B 33/08; H05B 33/0809; H05B 33/0815; H05B 33/0842; H05B 33/0848
USPC ... 315/185 R, 246, 250, 251, 291, 307, 308, 315/312
See application file for complete search history.

(56) References Cited

U.S. PATENT DOCUMENTS

| | | | | |
|---|---|---|---|---|
| 5,006,724 | A | 4/1991 | Liu | |
| 7,237,928 | B2 | 7/2007 | Takeda et al. | |
| 7,868,602 | B2 * | 1/2011 | Omi | H02M 1/36 323/284 |
| 10,056,828 | B2 * | 8/2018 | Morici | H02M 1/08 |
| 2012/0112662 | A1 | 5/2012 | Hatley et al. | |

* cited by examiner

*Primary Examiner* — Jimmy T Vu
(74) *Attorney, Agent, or Firm* — Oblon, McClelland, Maier & Neustadt, LLP

(57) ABSTRACT

Aspects of the disclosure provide a light emitting diode (LED) fade-in method. The method can include increasing an output current of an LED lighting system from an initial current level to an intermediate current level during a first phase of a fade-in process via a first set of current steps, and decreasing the output current of the LED lighting system from the intermediate current level to a target current level during a second phase of the fade-in process via a second set of current steps. The LED lighting system has a brightness resolution, and each of the first and second sets of current steps corresponds to a finest adjustable brightness value of the brightness resolution.

20 Claims, 5 Drawing Sheets

LIGHT INTENSITY CONTROL OF AN LED LIGHTING SYSTEM

TECHNICAL FIELD

This disclosure is related to light emitting diode (LED) light intensity control.

BACKGROUND

Light emitting diodes (LEDs) are broadly adopted for lighting applications in automotive industry. Advantages of using LEDs include low energy consumption, long lifetime, and small size. For example, an automobile may employ dozens of independently controllable LED lamps for exterior and interior lighting, and backlighting. One or more controllers can be configured to generate pulse width modulated signals to vary brightness of each LED lamp.

SUMMARY

Aspects of the disclosure provide a light emitting diode (LED) fade-in method. The method can include increasing an output current of an LED lighting system from an initial current level to an intermediate current level during a first phase of a fade-in process via a first set of current steps, and decreasing the output current of the LED lighting system from the intermediate current level to a target current level during a second phase of the fade-in process via a second set of current steps. The LED lighting system has a brightness resolution, and each of the first and second sets of current steps corresponds to a finest adjustable brightness value of the brightness resolution. According to this method, a brightness level of LEDs controlled by the LED lighting system can be increased quickly when a respective light intensity of the LEDs is low. As a result, brightness level changes are unperceivable during the first phase when the LEDs are turned on. During the second phase, the brightness level of the LEDs can be decreased slowly to a desired value. As the light intensity of the LEDs at the second phase is high, changes of the brightness level may be unnoticeable. A smooth fade in effect without noticeable brightness changes can thus be obtained when the LEDs are turned on.

In an embodiment, timings of the first and/or second sets of current steps are programmable. In one example, a shape of a current curve corresponding to the fade-in process is adjustable by changing the timings of the first and/or second sets of current steps.

In an embodiment, the timings of the first and/or second sets of current steps are stored in a memory of the LED lighting system or calculated according to a formula or an algorithm. The method can further include retrieving or calculating, by a central processing unit (CPU), one of the timings of the first set of current steps from the memory, and causing the output current to increase at the one of the timings of the first set of current steps. In one example, the CPU provides a brightness level value indicating an updated brightness level.

In an embodiment, a brightness control signal is transmitted from a controller to an LED driver. The brightness control signal indicates a brightness level that is changed at one of the timings of the first set of current steps. In one example, the brightness control signal is a pulse width modulation (PWM) signal.

Embodiments of the method can further include generating, by the LED driver, the output current at a current level that corresponds to the brightness level indicated by the brightness control signal, and increasing, by the LED driver, the output current by a height of a current step when the brightness level indicated by the brightness control signal is changed.

Aspects of the disclosure provide an LED lighting system. The LED lighting system can include a memory configured to store a first sequence of timings corresponding to a first phase of a fade-in process, and a second sequence of timings corresponding to a second phase of the fade-in process, or a formula or algorithm for calculating the first and second sequences of timings, an LED driver circuit configured to generate an output current for driving an LED, the output current corresponding to a brightness level indicated by a brightness control signal, and a controller configured to generate the brightness control signal indicating the brightness level, and to change the brightness level according to the first and second sequences of timings stored in the memory to perform a fade-in process.

During the fade-in process, the output current is increased from an initial current level to an intermediate current level during the first phase via a first set of current steps each corresponding to one of the first sequence of timings, and decreased from the intermediate current level to a target current level during the second phase via a second set of current steps each corresponding to one of the second sequence of timings. Each of the first and second sets of current steps corresponds to a finest adjustable brightness value of a brightness resolution of the LED lighting system.

Aspects of the disclosure provide a non-transitory computer-readable medium. The medium stores instructions that, when executed by a processor, cause the processor to perform an LED fade-in method. The method can include retrieving, from a memory, a first sequence of timings corresponding to a first phase of a fade-in process of a light emitting node (LED) lighting system having a brightness resolution, and subsequently a second sequence of timings corresponding to a second phase of the fade-in process, causing an output current of the LED lighting system to increase at each of the first sequence of timings by a current step, the current step corresponding to a finest adjustable brightness value of the brightness resolution, and causing the output current of the LED lighting system to decrease at each of the second set of timings by the current step.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

Figure 1:
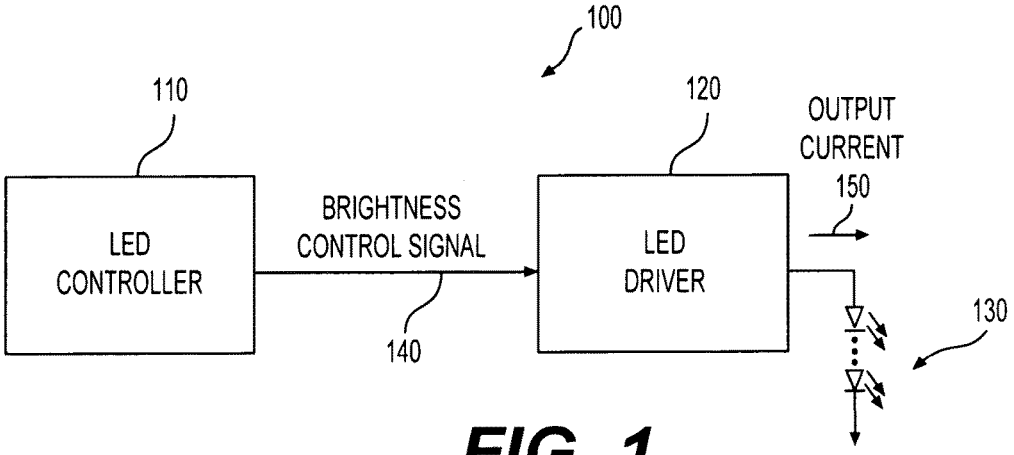
FIG. 1 shows a light emitting diode (LED) lighting system according to an embodiment of the disclosure.

FIG. 1 shows a light emitting diode (LED) lighting system 100 according to an embodiment of the disclosure. The LED lighting system 100 can include an LED controller 110, an LED driver 120, and an LED string 130. Those components are coupled together as shown in FIG. 1. In one example, the LED lighting system 100 is used in a vehicle to control an LED lamp to create a fade-in effect (e.g., a light intensity of the LED lamp is increased gradually).

The LED controller 110 can be configured to generate a brightness control signal 140 indicating a brightness level (or a light intensity level). The LED driver 120 can receive the brightness control signal 140 and accordingly generate an output current 150 to drive the LED string 130. The strength of the output current 150 can be determined according to the brightness level indicated by the brightness control signal 140. Thus, the brightness of the LED string 130 can be controlled to be what the brightness control signal 140 has indicated. By varying the brightness control signal 140, the output current 150 or an average of the output current 150 can vary, and consequently a time variable illumination effect of the LED string 130 can be obtained. The time variable illumination effect can include fade-in and fade-off (dimming down and dimming up), blinking, and the like.

The brightness control signal 140 may take different forms in various embodiments. For example, the brightness control signal 140 can be a pulse width modulation (PWM) signal, a duty cycle of which is modulated by a set of brightness levels. The brightness control signal 140 can be an analog voltage signal, a magnitude of which can be used as a reference for regulating the brightness of the LED string 130. In other examples, a communication interface may be implemented between the LED controller 110 and the LED driver 120, and a message including a brightness value may be transmitted to indicate a brightness level. Examples of the communication interface can include controller area network (CAN), local interconnect work (LIN), I2C, serial peripheral interface (SPI), and the like.

The LED controller 110 can include a central process unit (CPU), a memory, and a set of programmable peripheral components (e.g., PWM signal generators, timers, analog-to-digital converters (ADCs), communication interfaces). Depending on different functions required in various embodiments, the LED controller 110 can have different configurations, and may include different functional components. In one example, the LED controller 110 can be configured to control more than one LED driver circuits to manage multiple LED lights.

The LED driver 120 can be a circuit configured to generate the output current 150 for driving the LED string 130. The output current 150 can vary in response to a variation of the brightness control signal 140. In various embodiments, the LED driver 120 can include a linear LED driver circuit, or a DC/DC LED driver circuit. The LED driver 120 can be one of a boost converter, a buck converter, or a buck-boost converter in some examples. In various embodiments, the LED controller 110 and the LED driver 120 may be integrated into one integrated circuit, or may be two separated modules that are either integrated circuits or discrete circuits.

The LED string 130 can include any number of suitable LEDs suitable for different applications in various embodiments. In alternative examples, LEDs configured in parallel, or multiple LED strings may be coupled to the LED driver 120 in place of the LED string 130.

Figure 2A:
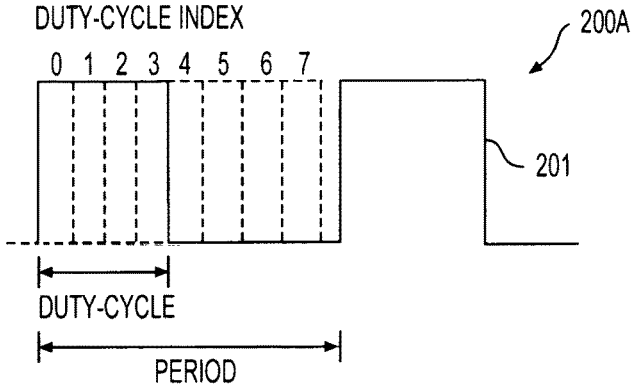
FIG. 2A shows an example pulse width modulation (PWM) signal according to an embodiment of the disclosure.

FIG. 2A shows an example PWM signal 200A according to an embodiment of the disclosure. The PWM signal 200A can include a sequence of pulses 201 that are periodically transmitted. Each pulse can have a width (referred to as a duty-cycle) that is modulated by brightness levels. As shown in FIG. 2A configuration, the duty-cycle can have 8 possible options indexed from 0 to 7 within a period of the PWM signal 200A. Thus, the PWM signal 200A is said to have a resolution of 3 bits and is capable to represent 2^3=8 number of brightness levels. Generally, a resolution of a PWM signal is determined by a maximum number of distinctive duty-cycles that can be accommodated in a period of the PWM signal, and is typically indicated by the number of bits corresponding to the total number of possible duty-cycles. For example, a PWM signal having a resolution of 8 bits can represent 2^8=256 number of brightness levels.

Figure 2B:
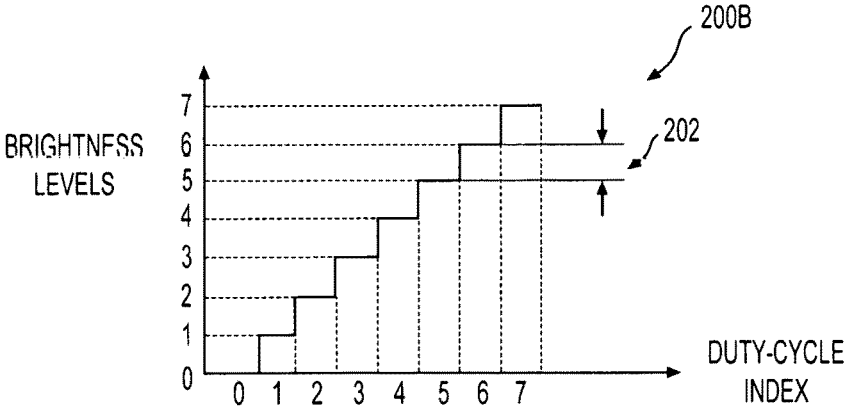
FIG. 2B shows an example mapping relationship between distinctive duty-cycles of the PWM signal in FIG. 2A and brightness levels.

FIG. 2B shows an example mapping relationship 200B between the distinctive duty-cycles of the PWM signal 200A and brightness levels. As shown, the indexes 0 to 7 corresponding to the different duty-cycles in FIG. 2A are arranged at a horizontal axis. Each index corresponds to a brightness level indicated at a vertical axis. Based on the duty-cycle and brightness level mapping relationship 200B, the LED controller 110 can transmit a PWM signal as the brightness control signal 140 to indicate a respective brightness level.

In addition, a PWM signal resolution can correspond to a brightness resolution of the LED lighting system 100. The brightness resolution of the LED lighting system 100 can indicate a granularity of brightness control of the LED lighting system 100, and can be measured with a maximum number of brightness levels the LED lighting system 100 can identify and manage. Similarly, a brightness resolution can be represented by a number of bits corresponding to the respective maximum number of brightness levels. For example, a brightness resolution of 8 bits correspond to 2^8=256 number of possible brightness levels. A difference 202 between two neighboring brightness levels, as shown in FIG. 2B, is a finest adjustable brightness value corresponding to the respective brightness resolution.

Figure 3:
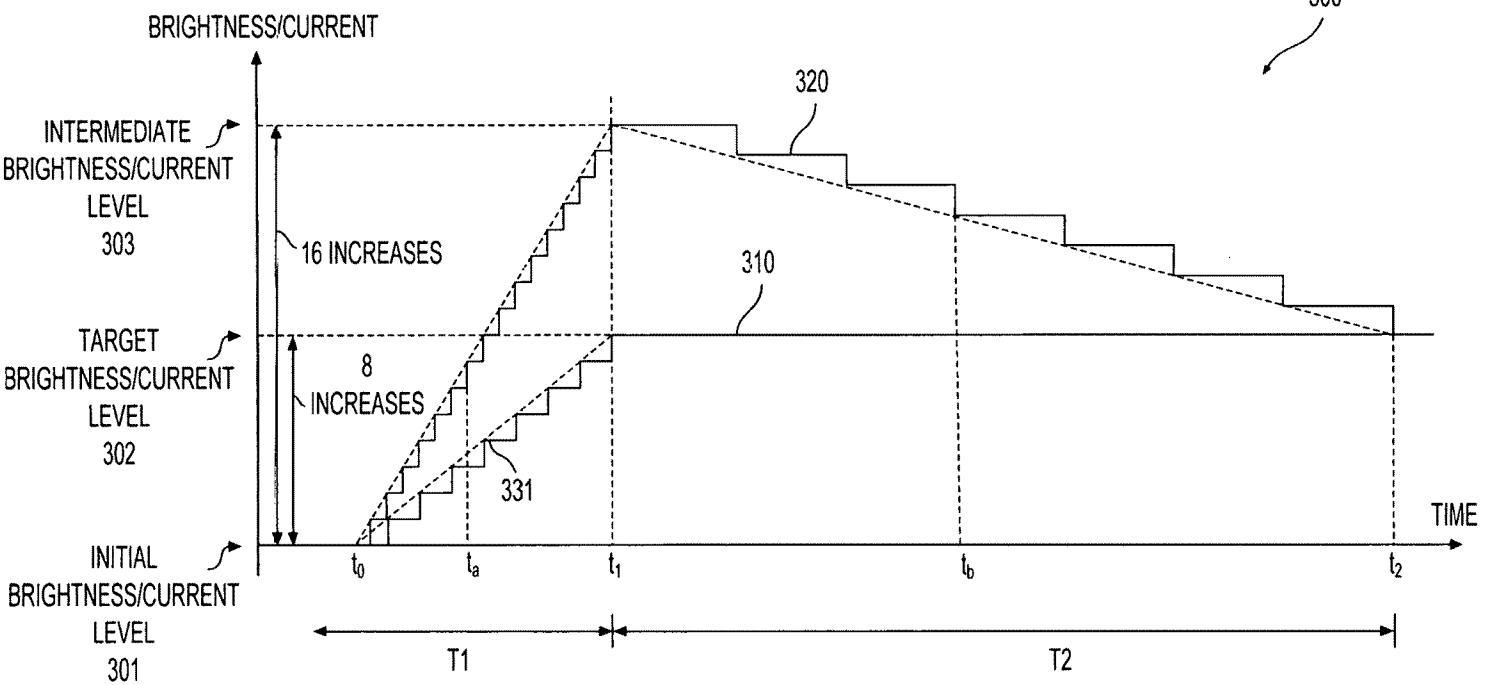
FIG. 3 shows two fade-in processes according to embodiments of the disclosure.

FIG. 3 shows two fade-in processes 310-320 according to embodiments of the disclosure. The two fade-in processes 310-320 can be implemented in the LED lighting system 100 in FIG. 1 example to obtain two different fade-in effects. During the fade-in process 310 or 320, the LED string 130 is dimmed up from an initial brightness level (e.g., a full dark) 301 to a target brightness level 302 or 303. For example, a dome light on the ceiling of a vehicle can be controlled by the LED controller 110 in FIG. 1 example. When a driver opens a door of the vehicle, the LED controller 110 can be triggered to gradually turn on the dome lamp to obtain a fade-in effect. The dome lamp may have a desired final light intensity at the end of this fade-in process. A desired final light intensity is referred to as a target brightness level of a respective lamp.

The two fade-in processes 310-320 corresponding to two brightness/current curves 310-320 shown in FIG. 3. Each of the brightness/current curves 310-320 shows the brightness of the LED string 130 or the output current 150 (or an average of the output current 150) passing the LED string 130 that vary over time during the fade-in processes 310 or 320. As the output current 150 determines the respective brightness at any time point, a same curve 310 or 320 is used to represent variations of both the brightness and the output current.

In the first process 310, the LED string 130 is dimmed up from the initial brightness/current level 301 at time to, and reaches the target brightness/current level 302 at time t1, which is shown by the brightness/current curve 310. Given a brightness resolution configuration of the LED lighting system 100, the difference between the initial brightness 301 and the target brightness 302 can correspond to a limited number of brightness/current steps 331 shown in FIG. 3. A height of each such brightness/current step 331 corresponds to a finest adjustable brightness value of the respective brightness resolution. As shown in FIG. 3, the target brightness 302 corresponds to at most 8 brightness/current steps or 8 brightness level increases.

Because the limited number of brightness level changes during a time period T1 between t0 and t1, a user (e.g., a driver) may notice the discontinuous changes of the brightness during the fade-in process 310. In other words, because the brightness of the LED string 130 changes too slowly from level to level, jumps of brightness corresponding to the brightness/current steps 331 may be noticeable in the fade-in process 310, especially during the initial stage when the brightness of the LED string 130 is low. It is commonly known that human eyes are sensitive to brightness changes when the respective light intensity is low, and not sensitive to brightness changes when the respective light intensity is high.

The second fade-in process 320 can include two phases. During a first phase of the time period of T1, the LED string 130 can be dimmed up from the initial brightness/current level 301 to an intermediate brightness/current level 303 that is higher than the target brightness 302. Because the intermediate brightness/current level 303 is higher than the target brightness/current level 302, more number of brightness level increases (e.g., 16 increases) can be accommodated during the period of T1 (compared with 8 increases in the fade-in process 310), resulting in a smoother fade-in effect compared with the fade-in process 310. During a second phase of a time period T2 between time t1 and t2, the LED string 130 can be dimmed down in a slower pace compared with the first phase until the target brightness/current level 302 is reached. Because the brightness level of the LED string 130 is high during the second phase, each brightness level change may not be noticed by a user.

As shown, the brightness/current curve 320 including a first set of current steps in the first phase (duration T1), and a second set of current steps in the second phase (duration T2). Each current step corresponds to a timing, such as timings $t_a$ and $t_b$ shown in FIG. 3. In order to implement the brightness/current curve 320, a first sequence of timings corresponding to the first set of current steps, and a second sequence of timings corresponding to the second set of current steps can be preconfigured. Based on the first and second sequence of timings, a sequence of brightness/current increases (the current steps in FIG. 3) can be carried out at respective timings, resulting the brightness/current curve 320.

In various examples, the length of the time period of T1, the intermediate brightness 303 may be configured differently than the FIG. 3 example. The brightness level changing pace (e.g., number of changes over a time period) can be controlled to be fast enough such that a smooth fade-in effect can be obtained.

Figure 4A:
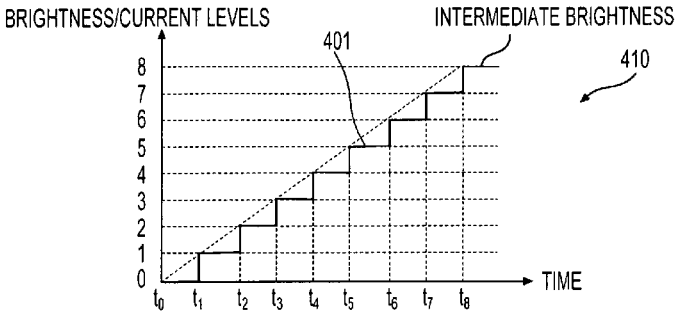
FIGS. 4A-4C show example brightness/current curves according to embodiments of the disclosure.
Figure 4B:
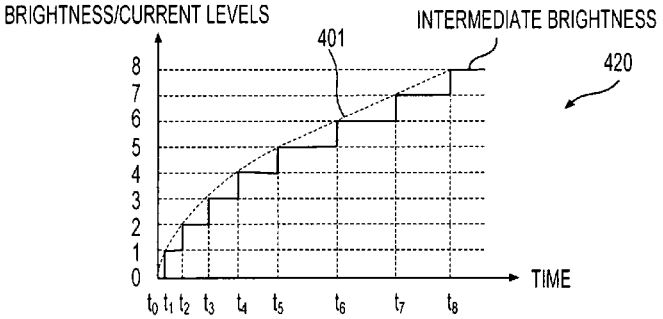
Figure 4C:
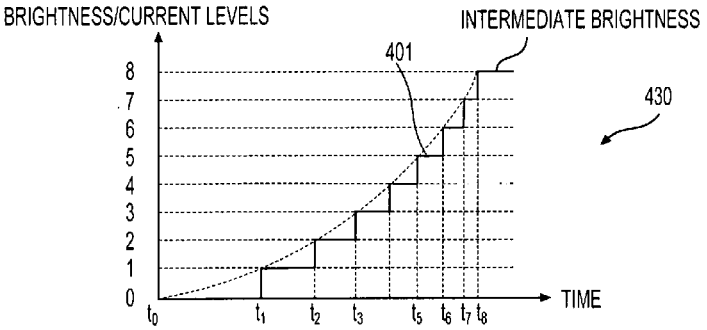

FIGS. 4A-4C show example brightness/current curves 410-430 according to embodiments of the disclosure. Each curve 410-430 can correspond to a first phase of a fade-in process in which the LED string 130 is dimmed up from an initial brightness level to an intermediate brightness level. Each curve 410-430 includes 8 brightness/current steps 401. Each of the 8 brightness/current steps 401 has a step height equal to the finest adjustable brightness value corresponding to a given brightness resolution. The 8 brightness/current steps 401 of each curve 410-430 take place at timings from t1 to t8, resulting in a respective brightness/current curve 410-430.

Particularly, due to configurations of the timings t1-t8, the three curves 410-430 present different shapes. For example, the curve 410 is linear. The curve 420 is logarithmic in a first portion before time t5, and is linear in a second portion after time t5. The curve 430 is exponential. Accordingly, in various embodiments, timings of respective brightness/current steps in a brightness/current curve are preconfigured such that brightness/current curves with various shapes can be obtained. As a result, different fade-in effects may be achieved that can be applicable to different application scenarios.

Figure 5:
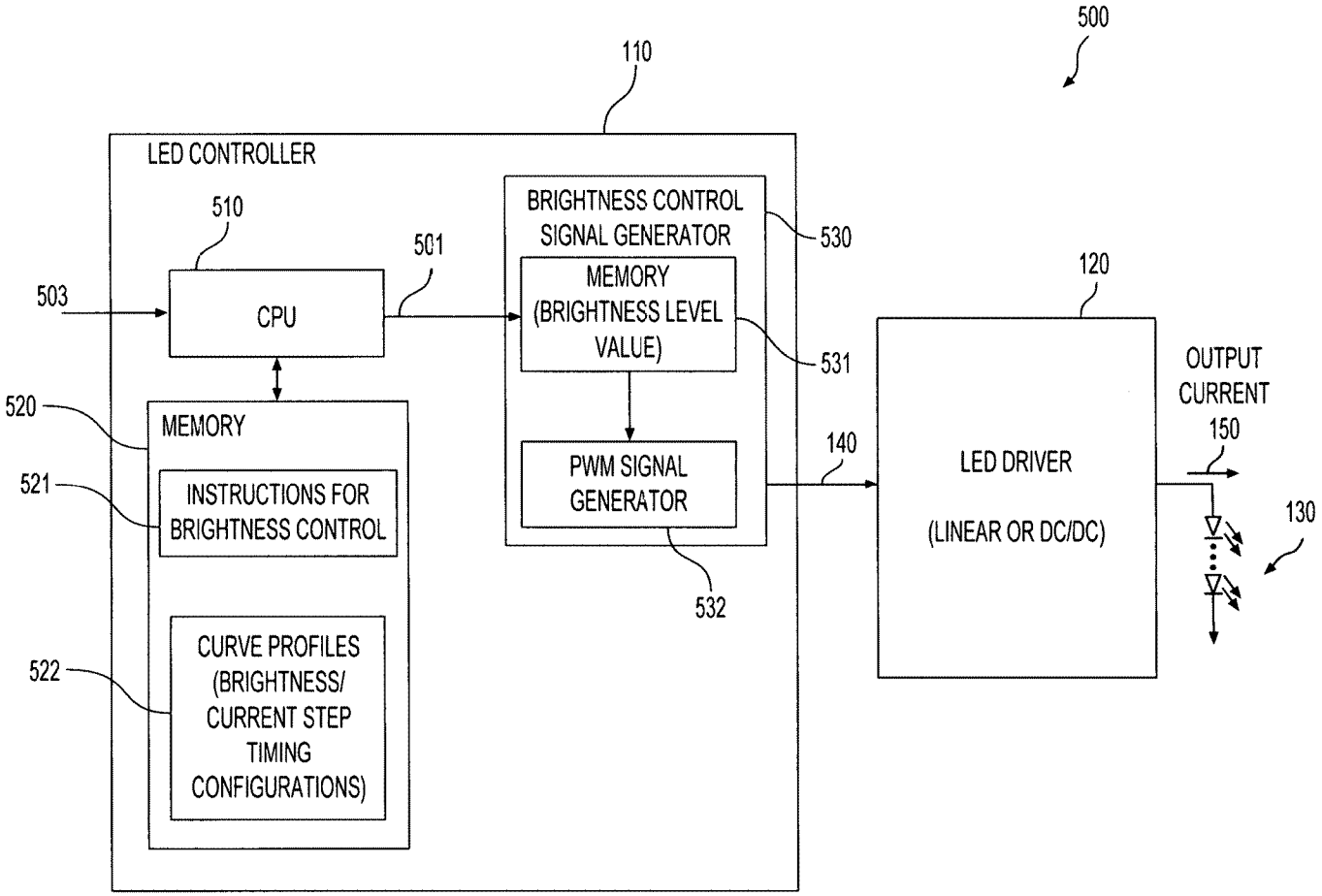
FIG. 5 shows an example LED lighting system according to embodiments of the disclosure.

FIG. 5 shows an example LED lighting system 500 according to embodiments of the disclosure. The system 500 implements the two-phase fade-in process 320 in FIG. 3 example to obtain a smoother fade-in effect compared with the one-phase fade-in process 310. As shown, the system 500 can include the LED controller 110, the LED driver 120, and the LED string 130.

In an embodiment, the LED controller 110 includes a CPU 510, a memory 520, and a brightness control signal generator 530. The memory 520 can be a non-transitory or transitory memory, such as a read only memory (ROM), a random access memory (RAM), a hard disk, a flash memory, and the like. The memory 520 can include multiple storage spaces for storing various programs or data. The memory 520 can store instructions 521 for brightness control functions or processes, such as fade-in functions or processes described herein. The memory 530 can further store one or more curve profiles 522, or formulas or algorithms (instructions) for deriving curve profiles.

Each curve profile 522 can include parameters associated with a brightness/current curve. For example, each curve profile 522 can include a first and second sequence of brightness/current step timings corresponding to the first and second phases, respectively, of a two-phase fade-in process, such as the fade-in process 320. The first or second sequence of brightness/current step timings may be configured in a particular way such that a particular curve shape can be created for the first or second phase. In some examples, brightness level values corresponding to each timing may also be included in the curve files 522. In one example, the curve files 522 may take forms of tables storing timing and/or brightness values.

In various embodiments, the curve profiles 522 can be programmable. For example, different curve profiles corresponding to different fade-in effects may be written into the memory 520 and used for different LED lamps. When necessary, the curve profiles 522 can be updated with other curve profiles. The memory 520 may additionally include other instructions for fulfilling other functions of the LED controller 110. Alternatively, the timings and respective brightness level values may be calculated using formulas or algorithms stored in the memory 520. For example, an initial set of parameters corresponding to a curve file or an indicator representing a curve file may be provided and stored in the memory 520. Accordingly, a curve file can be calculated using the formulas or algorithms.

In operation, the CPU 510, by execution of the instructions 521 and according to one of the curve profiles 522, can carry out a two-phase fade-in process. For example, while executing the instructions 521, the CPU 510 can receive a trigger signal 503 corresponding to a fade-in process. For example, when a driver opens a door of a vehicle installed with the LED lighting system 500, a sensor may generate the trigger signal 503 in response to the driver's action. In response to reception of the trigger signal 503, the CPU 510 may determine a respective curve profile 522 corresponding to the trigger signal 503. For example, for different trigger sources, different curve configurations may be needed for dimming up respective LED lamps. As a result, one curve profile can be selected from the multiple curve files.

Then, the CPU 510 may initiate a two-phase fade-in process to dim up the LED string 130. The fade-in process may start with an initial brightness specified in the selected curve profile, or the initial brightness may be a full dark when a parameter of the initial brightness is absent from the selected curve profile. For example, the CPU 510 can retrieve an initial brightness value from the selected curve file, and transmit a brightness level value 501 corresponding to the initial brightness to the brightness control signal generator 530.

Next, the CPU 510 can increase a brightness/current of the LED string 130 step by step to reach the intermediate brightness/current level according to the first sequence of brightness/current timings calculated or stored in the selected curve file, which corresponding to the first phase of the two-phase fade-in process. For example, the CPU 510 may retrieve a brightness/current timing from the respective curve profile 522 in the memory 520, or calculate the brightness/current timing and brightness value using a formula or an algorithm stored in the memory 520. A timer may be implemented by the CPU 510 according to the instructions 521. According to the timer, the CPU 510 can determine when it is the time to conduct an increase to the brightness/current of the LED string 130. Accordingly, the CPU 510 may increase the brightness/current at the retrieved timing.

For example, the CPU 510 may transmit a brightness level value 501 to the brightness control signal generator 530. For example, assuming the LED lighting system 500 has a brightness resolution of 8 bits, an eight-bit-length value can be used to indicate an updated brightness level. The brightness level value 501 may be larger than a previously transmitted brightness level value by a difference corresponding to a height of a brightness/current step. In this way, corresponding to the first sequence of timings stored in the memory 520, a sequence of brightness level values can be transmitted to the brightness control signal generator 530. In some example, the brightness level values may not be contiguous. For example, two or more current steps may exist between brightness changes corresponding to two successively generated brightness level values.

After the first phase of the two-phase fade-in process, the second phase of the two-phase fade-in process can be performed similarly by the CPU 510 to reach a target brightness/current level. For example, timings in the second sequence of timings can be calculated or retrieved from the memory 522 one by one, and respective brightness level values can accordingly be transmitted to the brightness control signal generator 530 at the respective timings.

The brightness control signal generator 530 receives the sequence of brightness level values, and accordingly generates brightness control signals 140 corresponding to the received brightness level values 501. In one embodiment, the brightness control signal generator 530 includes a memory 531 (e.g., a set of registers) for storing a received or calculated brightness level value. The brightness control signal generator 530 can further include a PWM signal generator 532. The PWM signal generator 532 can generate a PWM signal 140 having a duty-cycle corresponding to the received brightness level value stored in the memory 531. The PWM signal 140 functions as the brightness control signal 140 in FIG. 1, and is transmitted to the LED driver 120. When the brightness level value stored in the memory 531 is updated, the PWM signal 140 is accordingly updated.

The LED driver 120 can be a linear or DC/DC converter in various examples. In response to the brightness control signal 140 (e.g., a reference voltage, a PWM signal, and the like), the LED driver 120 can vary the output current 150 to adjust a brightness of the LEDs 130. In one example, controlled by the LED driver 120, the output current 130 is turned on and turned off repeatedly but being maintained at a constant level when turned on, such that an average current level corresponding to a desired brightness level can be obtained. Accordingly, corresponding to different brightness levels indicated by the brightness control signal 140, the LED string 130 shows different levels of brightness. Corresponding to the first and second sequence of brightness/current timings in the selected curve profile 522, a fade-in effect may be obtained.

Figure 6:
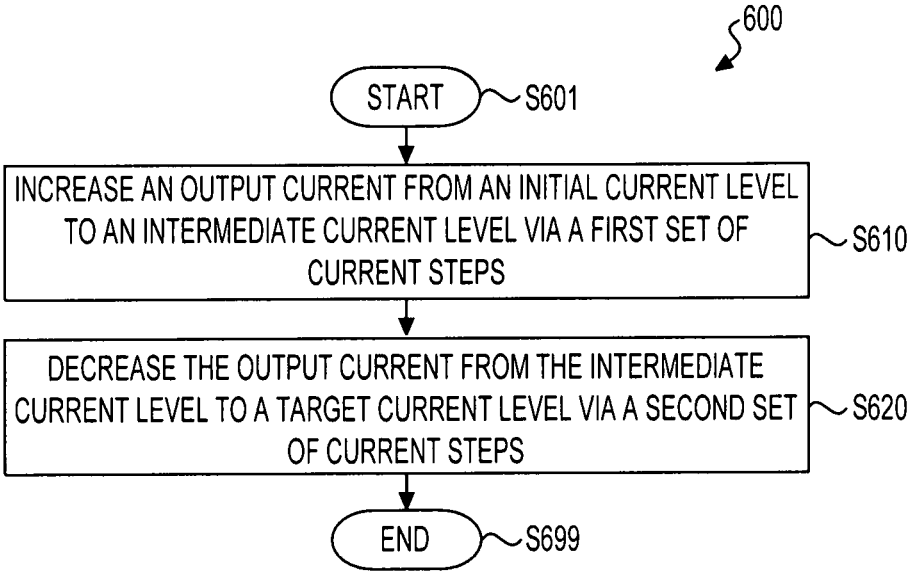
FIG. 6 shows an example two-phase fade-in process according to an embodiment of the disclosure.

FIG. 6 shows an example two-phase fade-in process 600 according to an embodiment of the disclosure. The process 600 can be performed at the LED lighting system 100 or 500. Given a desired target brightness level, an output current is first increased to an intermediate current level to accommodate more current steps, then decreased slowly to reach a target current level, resulting in an improved fade-in effect. The process 600 can start from S601 and proceed to S610.

At S610, the output current of an LED lighting system is increased from an initial current level to the intermediate current level during a first phase. A first current curve corresponding to this first phase can include a first set of current steps. A summation of heights of those current steps can equal the difference between the intermediate current level and the initial current level.

At S620, the output current of the LED lighting system is decreased from the intermediate current level to the target current level during a second phase. A second current curve corresponding to this second phase can include a second set of current steps. A summation of heights of those current steps can equal the difference between the intermediate current level and the target current level. The process 600 can proceed to S699, and terminate at S699.

Figure 7:
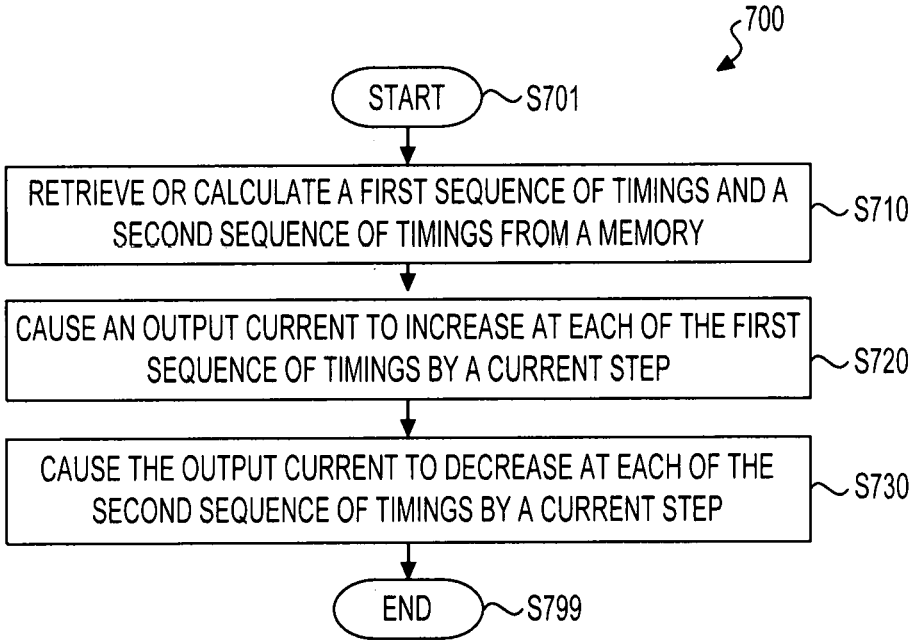
FIG. 7 shows another two-phase fade-in process according to an embodiment of the disclosure.

FIG. 7 shows another two-phase fade-in process 700 according to an embodiment of the disclosure. The process 700 can be performed by the CPU 510 in the LED controller 110. The process 700 starts from S701 and proceeds to S710.

At S710, a first and second sequence of timings and respective brightness levels can be retrieved from a memory. For example, the timings can be read from the memory one by one. In alternative examples, the timings and brightness levels can be calculated using a formula or an algorithm. S710 may be performed in parallel with S720 and S730 in some examples.

At S720, an output current of an LED lighting system is caused to increase at each of the first sequence of timings by a current step during a first phase. As a result, the output current may be increased to an intermediate current level at the end of the first phase. For example, the CPU 510 may provide a brightness level value to indicate an updated brightness level corresponding to one of the timings. A brightness control signal can then be adjusted according to the updated brightness level. Controlled by the brightness control signal, an LED driver may increase the output current by a current step.

At S730, the output current is caused to decrease at each of the second sequence of timings by a current step during a second phase. As a result, the output current may be decreased to a desired current level from the intermediate current level at the end of the second phase. For example, corresponding to one of the second sequence of timings, a brightness level value may be provided to indicate an updated brightness level. Similarly, in response to the brightness level value updating, the LED driver may decrease the output current by a current step. The process 700 may proceed to S799, and terminate at S799.

The processes and functions described herein can be implemented as a computer program which, when executed by one or more processors, can cause the one or more processors to perform the respective processes and functions. The computer program may be stored or distributed on a suitable medium, such as an optical storage medium or a solid-state medium supplied together with, or as part of, other hardware. The computer program may also be distributed in other forms, such as via the Internet or other wired or wireless telecommunication systems. For example, the computer program can be obtained and loaded into an apparatus, including obtaining the computer program through physical medium or distributed system, including, for example, from a server connected to the Internet.

The computer program may be accessible from a computer-readable medium providing program instructions for use by or in connection with a computer or any instruction execution system. The computer readable medium may include any apparatus that stores, communicates, propagates, or transports the computer program for use by or in connection with an instruction execution system, apparatus, or device. The computer-readable medium can be magnetic, optical, electronic, electromagnetic, infrared, or semiconductor system (or apparatus or device) or a propagation medium. The computer-readable medium may include a computer-readable non-transitory storage medium such as a semiconductor or solid state memory, magnetic tape, a removable computer diskette, a random access memory (RAM), a read-only memory (ROM), a magnetic disk and an optical disk, and the like. The computer-readable non-transitory storage medium can include all types of computer readable medium, including magnetic storage medium, optical storage medium, flash medium, and solid state storage medium.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

What is claimed is:

1. A method, comprising:

increasing an output current of a light emitting diode (LED) lighting system from an initial current level to an intermediate current level during a first phase of a fade-in process via a first set of current steps; and decreasing the output current of the LED lighting system from the intermediate current level to a target current level during a second phase of the fade-in process via a second set of current steps, wherein the LED lighting system has a brightness resolution, and each of the first and second sets of current steps corresponds to a finest adjustable brightness value of the brightness resolution.

2. The method of claim 1, wherein timings of the first and/or second sets of current steps are programmable.

3. The method of claim 2, wherein a shape of a current curve corresponding to the fade-in process is adjustable by changing the timings of the first and/or second sets of current steps.

4. The method of claim 1, wherein timings of the first and/or second sets of current steps are stored in a memory of the LED lighting system, or calculated according to a formula or an algorithm stored in the memory of the LED lighting system.

5. The method of claim 4, further comprising:

retrieving or calculating, by a central processing unit (CPU), one of the timings of the first set of current steps from the memory; and causing, by the CPU, the output current to increase at the one of the timings of the first set of current steps.

6. The method of claim 5, wherein the causing the output current to increase at the one of the timings of the first set of current steps comprises:

providing, by the CPU, a brightness level value indicating an updated brightness level.

7. The method of claim 4, wherein the increasing the output current comprises:

transmitting a brightness control signal from a controller to an LED driver, the brightness control signal indicating a brightness level that is changed at one of the timings of the first set of current steps.

8. The method of claim 7, wherein the brightness control signal is a pulse width modulation (PWM) signal.

9. The method of claim 7, wherein the increasing the output current further comprises:

generating, by the LED driver, the output current at a current level that corresponds to the brightness level indicated by the brightness control signal; and increasing, by the LED driver, the output current by a height of a current step when the brightness level indicated by the brightness control signal is changed.

10. A light emitting diode (LED) lighting system, comprising:

a memory configured to store a first sequence of timings corresponding to a first phase of a fade-in process, and a second sequence of timings corresponding to a second phase of the fade-in process, or a formula or algorithm for calculating the first and second sequences of timings;

an LED driver circuit configured to generate an output current for driving an LED, the output current corresponding to a brightness level indicated by a brightness control signal; and a controller configured to generate the brightness control signal indicating the brightness level, and to change the brightness level according to the first and second sequences of timings stored in the memory to perform a fade-in process, wherein, during the fade-in process, the output current is increased from an initial current level to an intermediate current level during the first phase via a first set of current steps each corresponding to one of the first sequence of timings, and decreased from the intermediate current level to a target current level during the second phase via a second set of current steps each corresponding to one of the second sequence of timings, and each of the first and second sets of current steps corresponds to a finest adjustable brightness value of a brightness resolution of the LED lighting system.

11. The LED lighting system of claim 10, wherein the first and second sequences of timings are programmable.

12. The LED lighting system of claim 11, wherein a shape of a current curve corresponding to the fade-in process is adjustable by changing the first and/or the second sequences of timings.

13. The LED lighting system of claim 10, wherein the controller includes a central processing unit (CPU) configured to:

retrieve, or calculate according to the formula or algorithm, one of the first sequence of timings; and increase the brightness level indicated by the brightness control signal at the one of the first set of timings.

14. The LED lighting system of claim 13, wherein the CPU is further configured to:

provide a brightness level value indicating an updated brightness level.

15. The LED lighting system of claim 14, wherein the controller further includes a brightness control signal generator configured to:

generate the brightness control signal indicating the brightness level according to the brightness level value provided by the CPU.

16. The LED lighting system of claim 15, wherein the brightness control signal is a pulse width modulation (PWM) signal.

17. The LED lighting system of claim 13, wherein the LED driver circuit is further configured to increase the output current when the brightness level indicated by the brightness control signal is changed.

18. A non-transitory computer-readable medium storing instructions that, when executed by a processor, cause the processor to perform a method, the method comprising:

retrieving, from a memory, a first sequence of timings corresponding to a first phase of a fade-in process of a light emitting node (LED) lighting system having a brightness resolution, and subsequently a second sequence of timings corresponding to a second phase of the fade-in process;

causing an output current of the LED lighting system to increase at each of the first sequence of timings by a current step, the current step corresponding to a finest adjustable brightness value of the brightness resolution; and causing the output current of the LED lighting system to decrease at each of the second set of timings by the current step.

19. The non-transitory computer-readable medium of claim 18, wherein the increasing or decreasing the output current of the LED lighting system comprises:

providing a brightness level value indicating an updated brightness level.

20. The non-transitory computer-readable medium of claim 18, wherein a shape of a current curve corresponding to the fade-in process is adjustable by changing the first and/or second sequences of timings.

* * * * *